US005407191A

United States Patent [19]

Ukai

[11] Patent Number: 5,407,191

[45] Date of Patent: Apr. 18, 1995

[54] DEVICE FOR CONVEYING SHEETS ONE BY ONE

[75] Inventor: Makoto Ukai, Kawasaki, Japan

[73] Assignee: Kabushiki Kaisha Toshiba, Kawasaki, Japan

[21] Appl. No.: 142,936

[22] Filed: Oct. 29, 1993

[30] Foreign Application Priority Data

| | | | |
|---|---|---|---|
| Feb. 12, 1993 | [JP] | Japan | 5-024012 |
| Feb. 16, 1993 | [JP] | Japan | 5-026517 |
| Oct. 5, 1993 | [JP] | Japan | 5-248947 |

[51] Int. Cl.[6] ..... B65H 7/02

[52] U.S. Cl. ..... 271/227; 271/265; 271/270; 271/272; 271/202

[58] Field of Search ..... 271/227, 228, 265, 270, 271/272, 202

[56] References Cited

U.S. PATENT DOCUMENTS

| | | | |
|---|---|---|---|
| 4,955,964 | 9/1990 | Hair | 271/227 |
| 5,078,384 | 1/1992 | Moore | 271/228 |
| 5,324,021 | 6/1994 | Onomoto et al. | 271/227 |

FOREIGN PATENT DOCUMENTS

| | | | |
|---|---|---|---|
| 5983837 | 1/1985 | Japan . | |
| 0008648 | 6/1991 | Japan | 271/228 |
| 3264429 | 11/1991 | Japan | 271/228 |
| 3267244 | 11/1991 | Japan | 271/228 |
| 4133943 | 5/1992 | Japan | 271/228 |

*Primary Examiner*—H. Grant Skaggs
*Attorney, Agent, or Firm*—Cushman, Darby & Cushman

[57] ABSTRACT

Endless drive belts are provided in a spaced-apart relation to each other such that one endless driven belt is set in contact with one of these drive belts and the other endless driven belt is set in contact with the other drive belt. The one drive belt is driven by one pulse motor through one drive roller and that other drive belt is driven by the other pulse motor through the other drive roller. A bill is conveyed with its opposed edges gripped by the drive and driven belts. A controller measures the skew of the bill and bill-to-bill interval on the basis of output signals detected by forward-stage detecting units against the conveying bill and controls the respective rotational speeds of the one pulse motor and that other pulse motor on the basis of a result of measurement.

8 Claims, 11 Drawing Sheets

FIG. 8A
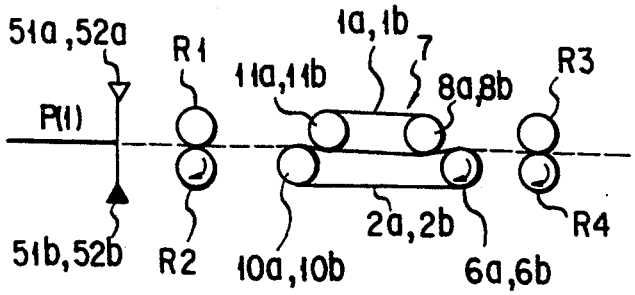
FIG. 8B
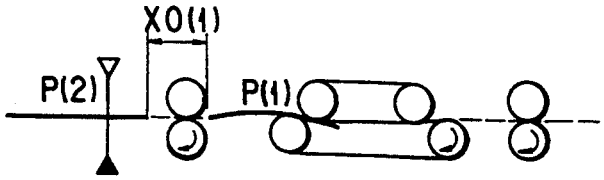
FIG. 8C
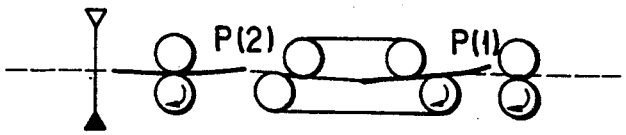
FIG. 8D
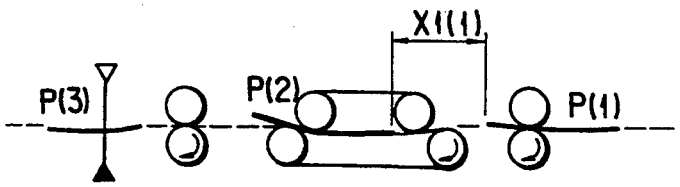
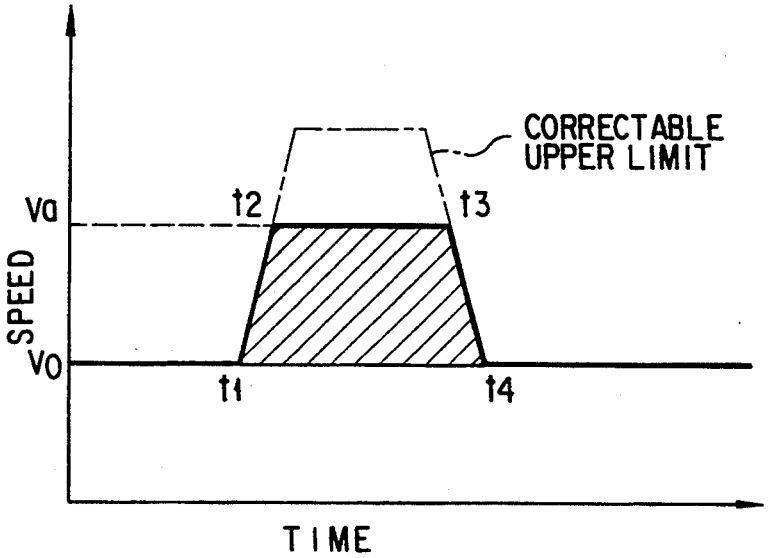
FIG. 9

DEVICE FOR CONVEYING SHEETS ONE BY ONE

BACKGROUND OF THE INVENTION

1. Field of the Invention

The present invention relates to a sheet conveying device for conveying bills one by one on a bill processing apparatus for sorting, for example, bills by their kinds of denominations and counting them.

2. Description of the Related Art

For example, a bill processing apparatus for sorting bills by their kinds of denominations and counting them is adapted to feed bills one by one from a stack of bills in a bill supplying section for conveyance, to inspect the bills for their kinds of denominations, extent of soiling, correct side, etc., by an inspecting section provided on a bill conveyance path and then sort the bills by a sorting section for their kinds of denominations extent of soiling, correct side, etc., while counting them, and to store them into a stacking section in accordance with their kinds of denominations, genuineness and corrected sides.

In the case where the bills are conveyed at a narrow conveying interval, while being separated one by one at a bill supplying section or some bill is skewed, there often occurs a determination error at the inspecting section, a sorting error at the sorting section, a stacking defect at the stacking section, etc.

In order to alleviate these problems, the bill conveying interval and skew amount are restricted to some extent by the delicate adjustment of the bill supplying section. However, it is not yet possible to solve the problems, such as supplying bills at a narrow pitch or in a skewed state due to a delicate bill-to-bill frictional force difference or a variation in the frictional force of the conveying belt made of rubber, thus causing a drop in the performance of the apparatus.

JPN 59-83837 discloses a conventional device as will be set out below. That is, the conventional device detects the interval, at which sheets are fed by a sheet feeding device, and delays a sheet feeding timing of the feeding device in accordance with sheet interval information.

According to this system it is possible to prevent the sheets from being fed at a small interval, but, admitting that the sheet feeding time is delayed, the processing capability of the sheet processing device is lowered, thus presenting a problem.

Further, even if the sheet feeding timing is delayed, it has not been possible to, as set out above, completely prevent the crowding of the sheets resulting from the delicate friction difference between the sheets.

SUMMARY OF THE INVENTION

It is accordingly the object of the present invention to provide a sheet conveying device which, by adjusting the conveying interval and skew of the sheet conveyed, can achieve less inconvenience and hence achieve a high performance.

According to the present invention there is provided a conveying device for conveying sheets comprising means for taking in the sheets one by one, a plurality of detection sensors, provided in a direction perpendicular to the taking direction of the sheet, for detecting passage of the sheet, first conveying means for conveying the sheet with its one end side gripped therewith in the direction perpendicular to the conveying direction of the sheet passed over the detecting sensors, second conveying means for conveying the sheet with its other end side gripped in the direction perpendicular to the conveying direction of the sheet passed over the detection sensors, first drive means for driving the first conveying means at predetermined velocity, second drive means for driving the second conveying means at predetermined velocity, means for calculating a interval of the sheet and subsequent sheet on the basis of output signals of the detection sensors, first detecting means for detecting any improper interval on the basis of results of the calculating means, second detecting means for detecting an amount of skew of the sheet from the difference of passing timing at which the sheet is detected by the detection sensors, first means for, when the improper interval is detected by the first detecting means, varying the velocity of the first and the second conveying means on the basis of results of the calculating means so as to correct the interval, and second means for varying the velocity of the first or the second conveying means on the basis of an output signal of the second detecting means so as to correct a skewed state of the sheet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 8A is an explanative view showing a bill conveying state;

FIG. 8B is an explanative view showing another bill conveying state;

FIG. 8C is an explanative view showing another bill conveying state;

FIG. 8D is an explanative view showing another bill conveying state;

FIG. 9 is an explanative view showing a pulse motor speed variation in the first embodiment;

DETAILED DESCRIPTION OF THE PREFERRED EMBODIMENTS

The embodiments of the present invention will be explained below with reference to the accompanying drawings.

Figure 1:
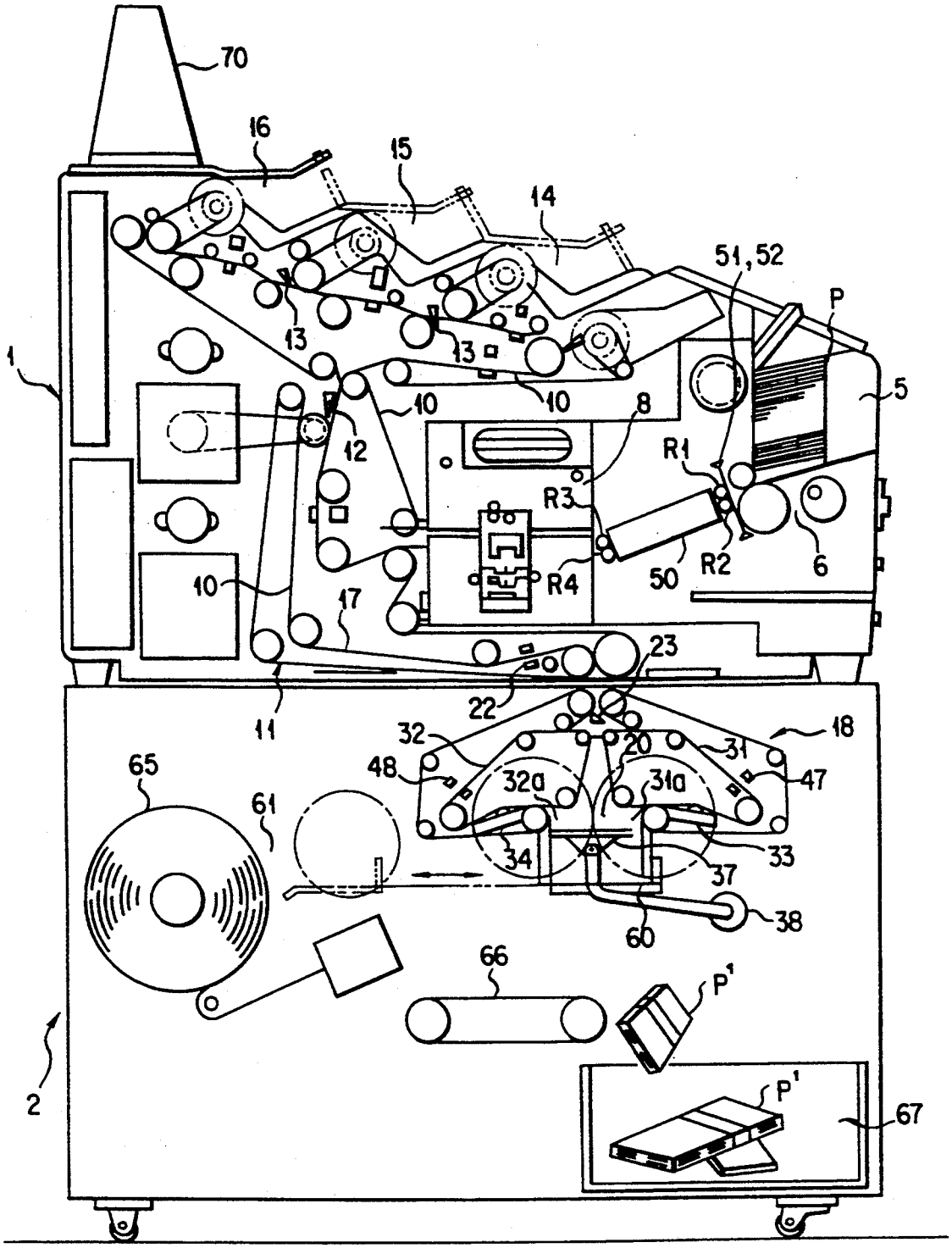
FIG. 1 is a perspective view diagrammatically showing a bill processing apparatus for a first embodiment of the present invention.

FIG. 1 diagrammatically shows a bill processing apparatus to which a sheet conveying device is applied. The apparatus is broadly classified into a bill sorting section 1 located on the upper side and a bill sealing section 2 located on the lower side as shown in FIG. 1.

The bill sorting section 1 has a supplying section 5 on a front side where many bills of different denominations are stackable.

Those bills P stacked in the supplying section 5 are sequentially fed one by one from the lower end side of the supplying section 5 by means of a feeder mechanism 6 and fed past feed rollers R1, R2, conveying device 50 and conveying rollers R3, R4 to an inspecting section 8.

A phototransistors 51*a*, 52*a* and infrared light emitting diodes 51*b*, 52*b* (light source) are provided such that they are spaced a predetermined distance from each other in a direction perpendicular to the direction, in which the bill P is conveyed, and serve as a means for detecting the passage of the bill P conveyed on a conveying path between the feeder mechanism 6 and the feed rollers R1, R2. The phototransistors 51*a*, 52*a* and light emitting diodes 51*b*, 52*b*, constitute a noncontacting sensors 51, 52. Based on the output signal of the sensors 51, 52 it is possible to measure the conveying interval of the bill P as will be set out below.

In the inspecting section 8 it is possible to optically or magnetically detect various kinds of information on the bill P by sensors and to identify their denomination, genuineness, etc.

The bill P moved past the inspecting section 8 is conveyed by a conveying means 11 equipped with many pulleys and endless belts 10 in a plurality of systems which are each wrapped around the pulleys. The bills are sorted in predetermined directions by the switching of gates 12, 13, 13 located at the corresponding branches on the conveying path and, when the bills are to be collectively sorted in accordance with their denominations, they are collected into a plurality of pockets 14, 15, 16 on the upper side of the bill sorting section 1 in accordance with their denominations.

Those bills P of a specifically designated denomination are fed, by the action of the gate 12, through a conveying path 17 to a temporary stacking section 20 of the stacking unit 18 in the bill sealing section 2 and stacked as a predetermined number of sheets with their correct sides oriented.

Partway of the conveying path 17 for conveying the bills P to the stacking unit 18 a surface sensor 22 is provided for identifying the correct side of the bill P. The bill P passing through the sensor 22 has its travelling direction controlled by a gate 23 responsive to a signal coming from the sensor 22 so that it can be sent selectively to either one of a "correct side" conveying path and "reverse side" conveying path. The outlets 31*a*, 32*a* of these conveying paths 31 and 32 face each other with the temporary stacking section situated therebetween so that the bills P are stacked with their correct sides oriented.

A sorting means is provided near the outlets 31*a*, 32*a* and has separators 33 and 34. A rest base 37 is so provided as to be liftable. A motor 38 for a back-up mechanism which liftably drives the rest base 37 can displace the rest base 37 to a high level corresponding to the number of bills P stacked.

Sensors 47 and 48 are provided on the conveying paths 31 and 32, respectively, so as to detect the leading edge of the bill P. These sensors 47 and 48 serve as a count means for counting the number of bills P to be sent to the temporary stacking section 20.

A carrier 60 is provided below the temporary stacking section 20 to receive a predetermined number of bills P stacked on the rest base 37. The carrier 60 is reciprocably movable, by a driving means not shown, from the temporary stacking section 20 to a bill sealing section 61 where the predetermined number of bills P is bundled by a band 65.

A conveyor 66 and receiving section 67 are provided on the lower side of the bill sealing unit 61, the conveyor 66 receiving a bundle of bills P' and the receiving section 67 receiving the bundle of bills P' conveyed by the conveyor 66.

In the bill processing apparatus as set out above, processing is made at a very high speed of about 10 sheets per second. The speed with which the bill is conveyed is as high as about 1600 mm/s. It is to be noted that the adjacent bills are conveyed in an about 84 mm spaced-apart relation in which case the bill is 76 mm on its short side.

In the bill processing apparatus it is desired that the bills be separately conveyed at a normal interval of about 84 mm. This is because, if the bills are conveyed at a close interval, that is, at a short pitch, it becomes difficult to make pattern matching processing on the printing pattern, etc., at the inspecting section 8. In the inspecting section 8 it takes a reasonable time to read out the printing pattern, thickness and other information of the bill P and to inspect the bill for its denomination, correct side, extent of soiling, presence of any hole, etc. In the case where, during the processing of one bill, the next bill is conveyed, it is not possible to accurately inspect the bill for these items of information.

Since an actuator for use at the sorting gate 12, etc., is operated at a time interval of about 20 ms, it is necessary that those bills conveyed at the conveying speed of 1600 mm/s be fed at a time interval of at least about 32 mm. In this case, the accurate bill-sorting time interval is of the order of at least 40 mm, taking into consideration the processing time of a controller, variation in the characteristic of the machine, and so on. The conveying interval of 50 mm or less than 50 mm poses a problem if its margin has to be taken into consideration.

The technique for accurately separating one bill from another and carrying it properly is very difficult and, in the case where, in particular, new and not new bills are stacked in a mixed manner, it has not been possible to accurately separate and convey bills because there is a difference in their frictional coefficient. As a result, the bills are fed, for example, at a close pitch, thus producing a problem.

In such a bill processing apparatus it is desired that a separated/fed bill be conveyed without being skewed. If the bill is conveyed in a "skewed" fashion, it is difficult to perform pattern matching, such as the print pattern on the bill, by an inspecting section 8.

If the bill is skewed to a greater extent, it is not possible to properly convey it due to the limited conveying width of the conveying device.

The technique for conveying the bills, while separating one bill from the next bill, is very difficult. If, in particular, new and not-new bills are mixed in the stack of the bills, it has not been possible to correctly convey the bills in a sheet-by-sheet fashion due to the difference in their frictional coefficient. As a result, a "skew" phenomenon occurs upon the conveyance of the bills, thus frequently encountering a conveyance problem.

This problem has been solved according to the conveying device 50 of the present invention as will be set out below.

Figure 2:
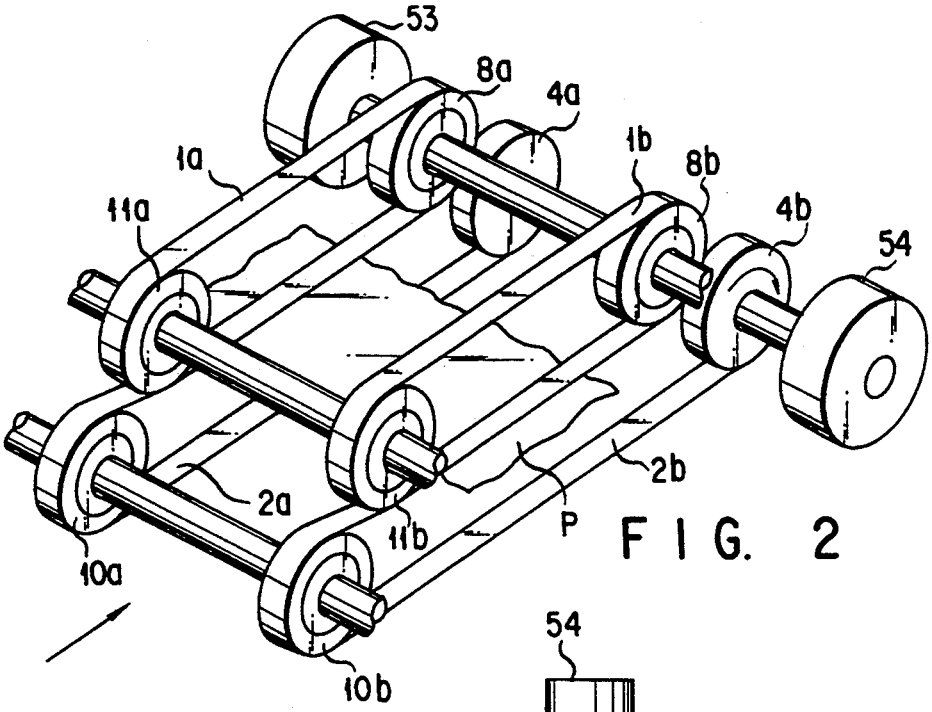
FIG. 2 is a perspective view diagrammatically showing a sheet conveying device according to a first embodiment of the present invention.
Figure 3:
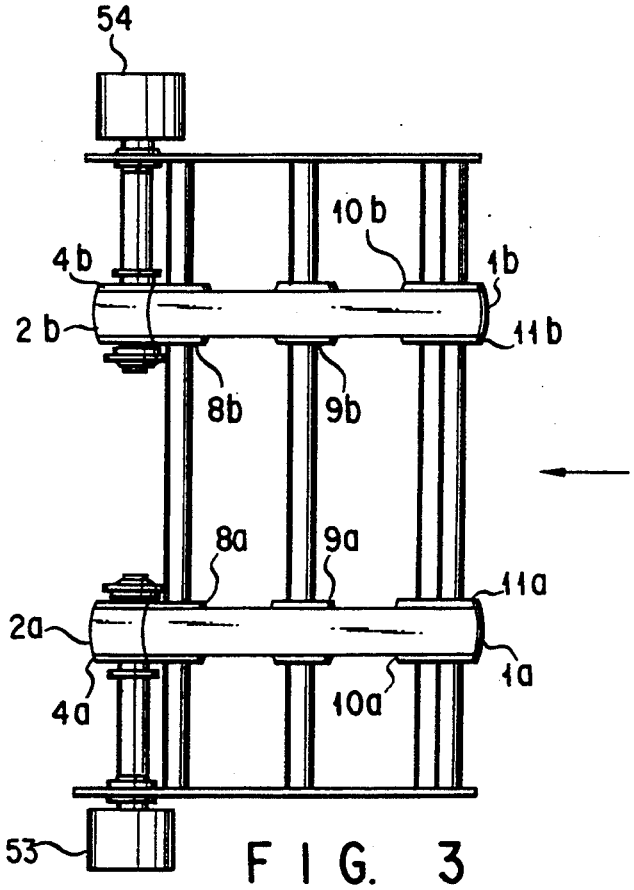
FIG. 3 is a plan view showing the arrangement of the first embodiment of the present invention.
Figure 4:
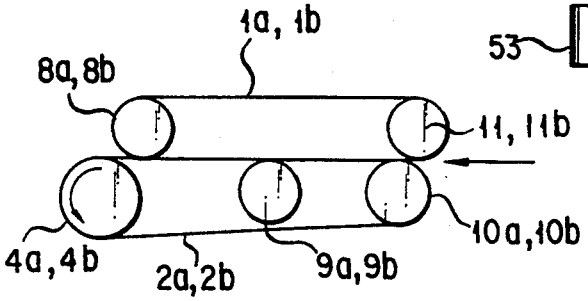
FIG. 4 is a side view showing the arrangement of the first embodiment.

FIGS. 2, 3 and 4 show, in more detail, the conveying device 50 according to the first embodiment.

Drive rollers 4*a*, 4*b* can be driven in any given direction at any given speed by associated pulse motors 53, 54 and a controller as will be set out below and can vary their speeds timewise.

Since drive belts 2*a*, 2*b* are moved by being pulled by the drive rollers 4*a*, 4*b*, those driven belts 1*a*, 1*b* are moved by being driven by the confronting drive belts 2*a*, 2*b*.

Since the drive belts 2*a*, 2*b* are independently driven, it is possible to correct the skew of the bill P, by different drive speeds, gripped between the belts 1*a* and 2*a* and between the belts 1*b* and 2*b*.

It might be considered that, if different speeds are involved on the right and left conveying belts (1*a*, 2*a*, 1*b*, 2*b*), the gripped bill P will cause a warp due to the small stiffness of the bill. As a result of experiments, however, it is found that no warp of the bill occurs, if the bill is stiff, and that only the extent of a skew of the bill varies with the bill held in its own rectangular configuration by a delicate slip in a direction perpendicular to those conveying directions of the right and left belts. In this way it is possible to convey the bill in a normal fashion.

Since the pulse motors 53 and 54 are variable, it is possible to correct the aforementioned short pitch.

Figure 5:
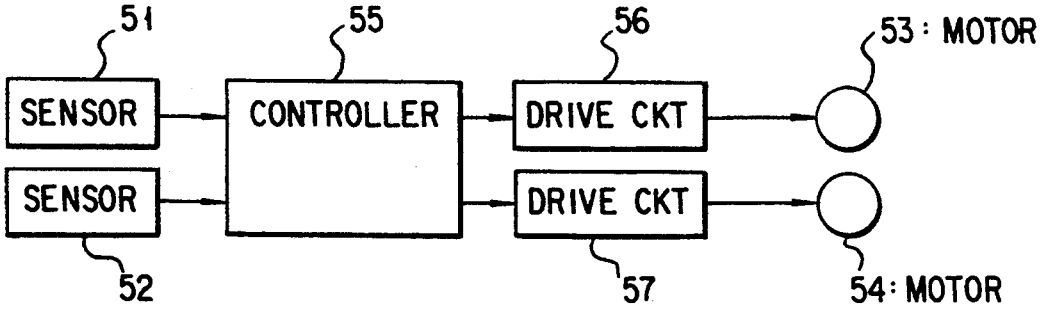
FIG. 5 is a block diagram diagrammatically showing an electric circuit for the first embodiment of the present invention.
Figure 7:
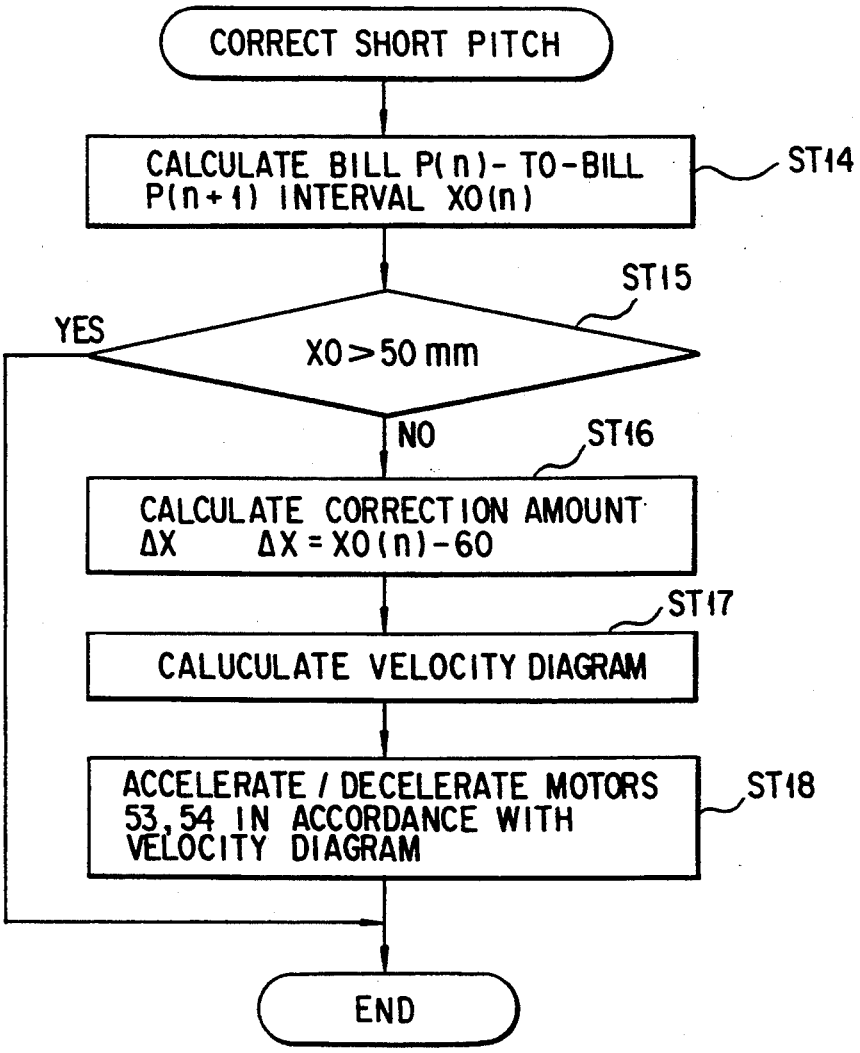
FIG. 7 is a flow chart for explaining the short pitch correct for the first embodiment of the present invention.

FIG. 5 diagrammatically shows a electric circuit for the conveying device 50 thus constructed. To be specific, the outputs of the sensors 51 and 52 are sent to the controller 55. Based on the output signals of the sensors 51 and 52 the controller 55 measures the skew of the bill P by a timing difference produced by the light interruption of the passing bill at the sensors 51 and 52 as will be set out below in more detail. Based on the result of measurement the controller 55 controllably drives the pulse motors 53 and 54 through drive circuits 56 and 57.

Figure 6:
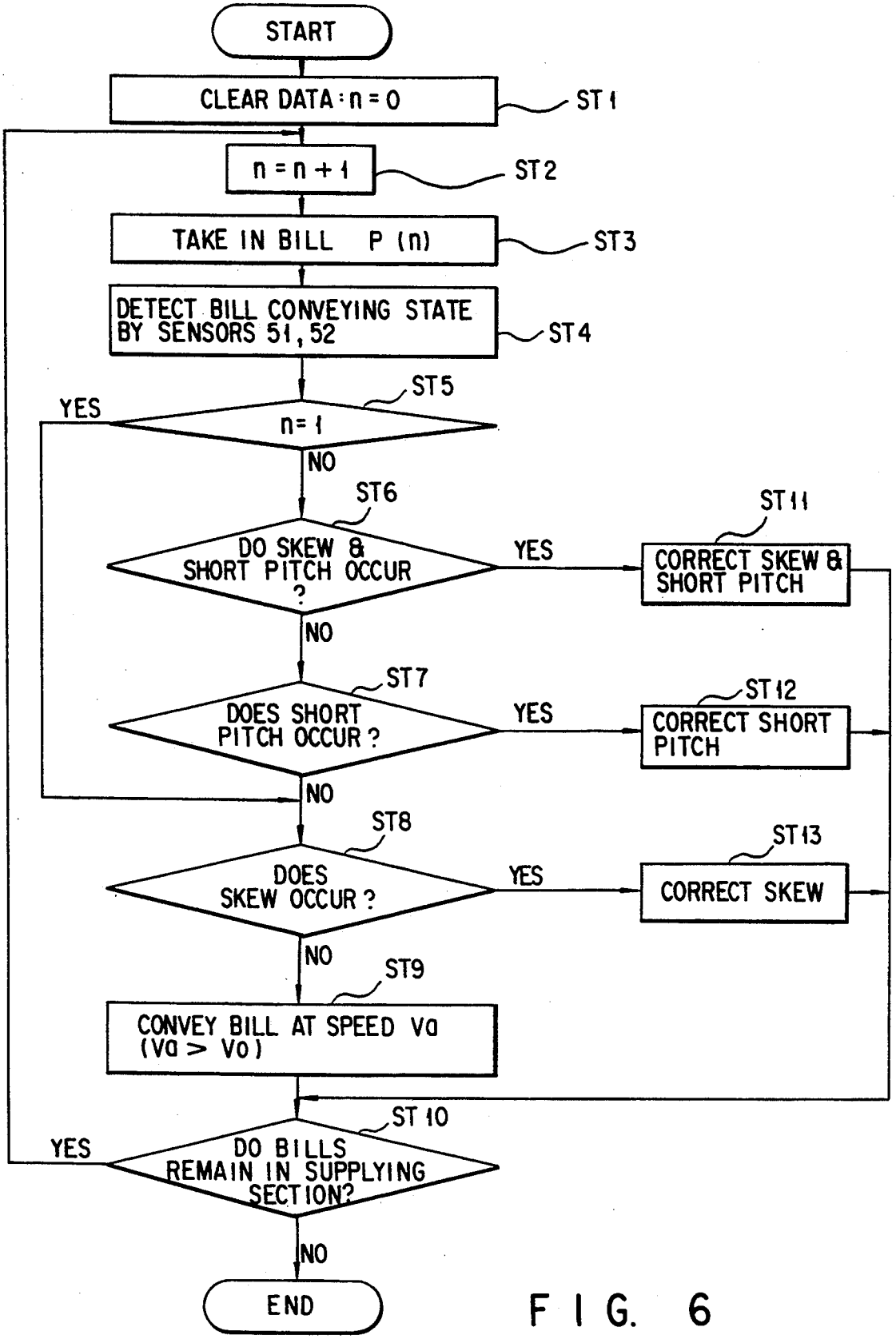
FIG. 6 is a flow chart for explaining the operation of the conveying device for the first embodiment of the present invention.

In such an arrangement, the operation of the conveying device 50 will be explained below with reference to FIG. 6.

First, before the conveying start of the bill, various data are cleared and bill managing data n is set to 0 (ST1).

Then the bill managing data n is set to 1 (ST2).

The bill P(n) is fed by the feeder mechanism 6 (ST3).

The bill P(n) thus fed is detected by the sensors 51, 52 for its conveying state (ST4).

It is determined whether or not N=1, that is, the bill is a first bill (ST5). If n=1, it is determined by the sensors 51, 52 on the basis of its detected conveying state whether or not the skew of the bill occurs (ST8).

If the skew of the bill occurs, the bill is conveyed by the conveying device 50 at a speed of Va (ST9). Here, the speed Va is higher than the normal bill conveying speed 1600 mm/s and a distance of the bill is increased relative to the next following bill P(2).

It is determined whether or not there remains any bills in the supplying section 5 (ST10). If yes, control is back to ST2 and +1, is added to the counter n and the next bill P(2) is taken out of the supplying section. On the bill P(2) the aforementioned processing is performed as at ST4 and ST5. At ST5, it is determined that the first bill is not present. That is, it is determined, from the conveying state of the second and subsequent bills detected by the sensors 51, 52, whether or not there occur any skew and short pitch (ST6), there occurs any short pitch (ST7) and there occurs any skew (ST8). If both the skew and short pitch occur, they are simultaneously corrected by the conveying device 50—ST11. If there occurs the short pitch, it is corrected by the conveying device 50—ST12. If, on the other hand, there occurs the skew, it is corrected by the conveying device 50—ST13. The aforementioned skew and short pitch will be explained below in more detail on the basis of FIGS. 7 to 15.

First, the correction of the short pitch will be explained below with reference to FIGS. 7 to 10.

First, the method for making processing in the case where a first bill P(1) is fed at an exceptionally narrow pitch relative to a second bill P(2), for example, at a pitch (conveying interval) of 50 mm or less than 50 mm, will be explained below.

As shown in FIG. 8A, the processing of the bill P is started. At the stack of bills P set at the supplying section 5, the bottommost bill P(1) is fed, by the feeder mechanism 6, from the supplying section 5 at a speed of 1600 mm/s. The bill P(1) is fed past an area between the phototransistors 51*a*, 52*a* and the infrared light emitting diodes 51*b*, 52*b* in the sensors 51, 52 where light coming from the light emitting diodes 51*b*, 52*b* is interrupted. The bill is conveyed past the feed rolls R1 and R2 at substantially the same speed. It is to be noted that the normal conveying speed of the bill processing apparatus is 1600 mm/s.

As shown in FIG. 8B, the bill P(1) is conveyed, while being gripped by the belts 1*a*, 1*b*, 2*a* and 2*b* of the conveying device 50 which are driven at a constant speed substantially corresponding to that of the feed rollers R1 and R2. The bill P(1) leaves, in this way, the sensors 51, 52 and then the feed rollers R1 and R2 and is conveyed while having its trailing edge gripped by the belts 1*a*, 1*b*, 2*a* and 2*b* in the conveying device 50. Subsequently, the next bill P(2) is fed by the feeder mechanism 6 and, after interrupting the light from the sensors 51, 52 conveyed by the feed rollers R1 and R2.

The controller 41 determines an initial conveying interval X0(1) corresponding to the conveying interval from the trailing edge of the bill P(1) to the leading edge of the bill P(2) from a time difference based on the light interruption at the sensor 51, 52. When, for example, the bill whose short side is 76 mm in length is conveyed in the "short side" direction at a constant speed of 1600 mm/s in which case a time difference between the leading edge of the bill P(1) and that of the bill P(2) is 0.1 second at the sensors 51, 52 then the initial conveying interval X0(1) becomes $$1600\times0.1-76=84$$

That is, the initial conveying interval X0(1) for the aforementioned case is measured as being 84 mm.

As shown in FIG. 8C, the controller 41 determines whether or not the P(1)-to-P(2) conveying interval X0(1) is a normal interval. For example, if the initial conveying interval X0(1) is exceeds 50 mm, then the controller determines the interval X0(1) as being normal. If, on the other hand, the initial conveying interval X0(1) is 50 mm or less than 50 mm, then the controller makes necessary control of the conveying interval, for example, makes the P(1)-to-P(2) interval at a narrow pitch. In the correction of the conveying interval, a 10 mm margin is secured for correction in view of a control error for the pulse motors 53, 54 for driving the conveying device 50 as well as an amount of the displacement occurring between the bill and belts 1*a*, 1*b*, 2*a* and 2*b* in the conveying device 50 (displacement occurs in particular upon variation of the belt speed). Therefore, 60 mm is taken as a correction calculation value (a target value) of the conveying interval. In the absence of such an error displacement, correction is made in units of 1 mm so as to exceed 50 mm after correction (51 mm is also possible). To be specific, for the conveying interval X0(1) being 50 mm or less than 50 mm, the controller 41 computes, from the interval X0(1), a speed curve of the pulse motors 53, 54 for driving the conveying device 50.

When the bill P(1) is conveyed to the conveying device 50, the controller 41 drives the pulse motors 53, 54 of the conveying device 50 based on the result of computation, that is, drives the pulse motors 53, 54 in a given acceleration pulse drive mode starting from the constant speed mode. The controller 41 drives the pulse motors 53, 54 in that given acceleration pulse drive mode and then decelerates the pulse motors 53, 54 back to the constant speed mode.

On the other hand, the controller 41 enables the bill to be conveyed, while driving the pulse motors 53, 54 at the constant speed, if the bill conveying interval is normal, for example, exceeds 50 mm.

The bill P is fed from the conveying device 50 to a downstream side at the constant speed.

The controller 41 performs, in this way, the speed control during the time period in which the bill is gripped by the belts 1*a*, 1*b*, 2*a* and 2*b* in the conveying device 50. Further, the bill P enters and leaves the conveying device 50 at the usual constant speed so that it is possible to prevent any inconvenience resulting from the speed difference between the preceding stage and the following stage.

As will be seen from FIG. 8D, the P(1)-to-P(2) conveying interval becomes an interval X1(1) as a result of adjustment of the aforementioned conveying interval. In this case, an amount of variation, $\Delta X=(X1(1)-X0(1))$, of the conveying interval is determined from the acceleration and deceleration times of the pulse motors 53, 54.

If the bill P conveyed at the constant speed of 1600 mm/s is fed at the speed of 1800 mm/s for one period in the case where the P(1)-to-P(2) initial conveying interval X0(1) is 40 mm, then the conveying distance of the bill is increased by $$\Delta X=(1800-1600)\times0.1=20\text{ mm}$$

compared with the case where the bill is conveyed at the constant speed. That is, the first bill P1 is sped up by 20 mm relative to the second bill P(2).

As a result, the P1-to-P2 initial conveying interval X0(1)=40 mm becomes the conveying interval X1(1)=60 mm after adjustment has been made. Since the conveying distance is 60 mm, subsequent processing, such as inspecting, etc., involves less inconvenience resulting from the conveying distance.

Since the speed of the pulse motors 53, 54 cannot be abruptly varied, it is necessary for the controller 41 to compute the conveying distance involving a slow-up or slow-down, not a simple step speed variation.

In the case where the speed of the pulse motor is varied as shown in FIG. 9 for example, the amount of variation, ΔX, of the conveying interval becomes a cross-hatched area in FIG. 9. Hence the amount of variation, ΔX (mm), becomes $$\Delta X=((t4-t1)+(t3-t2))\times(Va-Vo)/2$$

The conveying distance can be made greater by an extent corresponding to that value.

The case of the narrow P(1)-to-P(2) conveying interval has been explained above and, by referring to FIGS. 10A to 10E, explanation will now be made of the case where a narrow conveying interval is involved between an n-th bill and an (n+1)Ist.

Figure 10A:
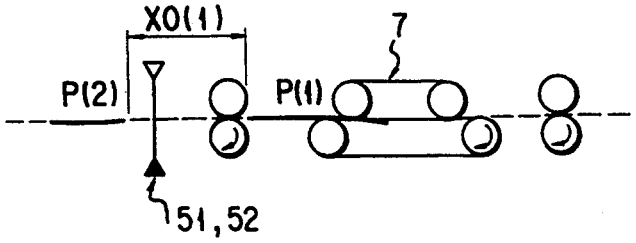
FIG. 10A is an explanative view showing the method for controlling the conveying interval of a bill conveyed.
Figure 10B:
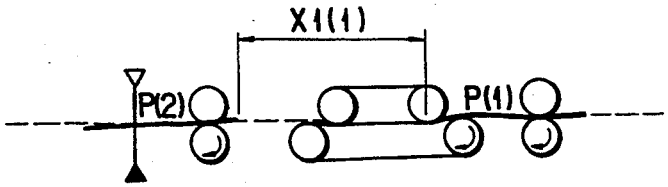
FIG. 10B is an explanative view showing the method for controlling the conveying interval of the bill conveyed.
Figure 10C:
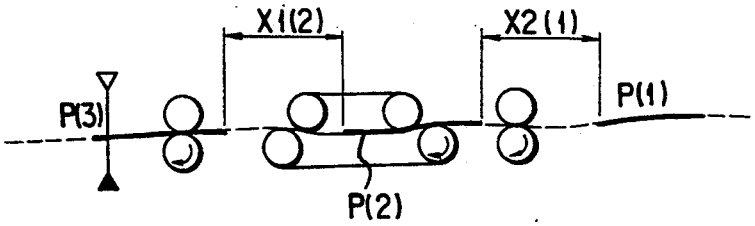
FIG. 10C is an explanative view showing the method for controlling the conveying interval of the bill conveyed.

Let it to be assumed that, after processing has been started as in FIGS. 10A to 10C, at the aforementioned step ST9, the bills P, . . . are sequentially accelerated starting with a first bill P1 in which case the position of the bills P, . . . is normally more advanced than their initial set position corresponding to the position in which the bills are conveyed at a normal speed of 1600 mm/s.

That is, the controller 41 accelerates the bill P(1) by the conveying device 50 such that the initial P(1)-to-P(2) conveying interval X0(1) is changed to a corresponding P(1)-to-P(2) acceleration conveying interval X1(1). In this way, the subsequent bill P(2) is accelerated and, when the bill P(1) is fed from the conveying device 50, the P(1)-to-P(2) conveying interval becomes X2(1), an interval substantially equal to the initial conveying interval X0(1). During the sequential feeder of the bill P from the conveying device 50 to the advance of the following bill P into the conveying device 50, processing is continuously performed by the controller 41 so that a great bill-to-bill interval is set.

Figure 10D:
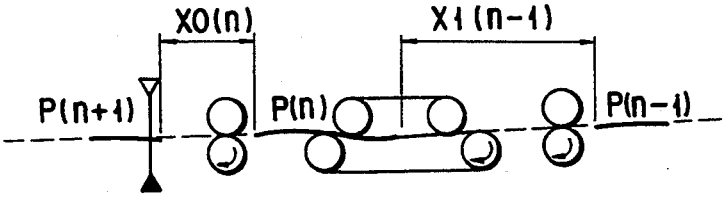
FIG. 10D is an explanative view showing the method for controlling the conveying interval of the bill conveyed.

As seen from FIG. 10D, on the other hand, when at the stage of advancing the bill P(n) into the conveying device 50 the following bill P(n+1) interrupts the light of the sensors 51, 52 the controller 41 computes the initial conveying interval X0(n).

Figure 10E:
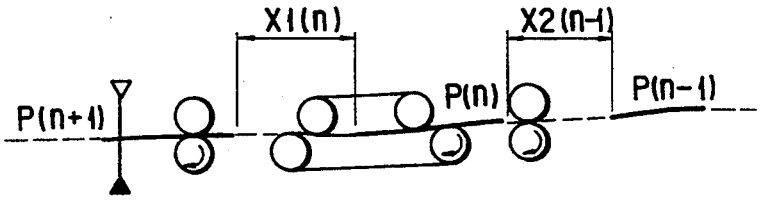
FIG. 10E is an explanative view showing the method for controlling the conveying interval of the bill conveyed.
Figure 11:
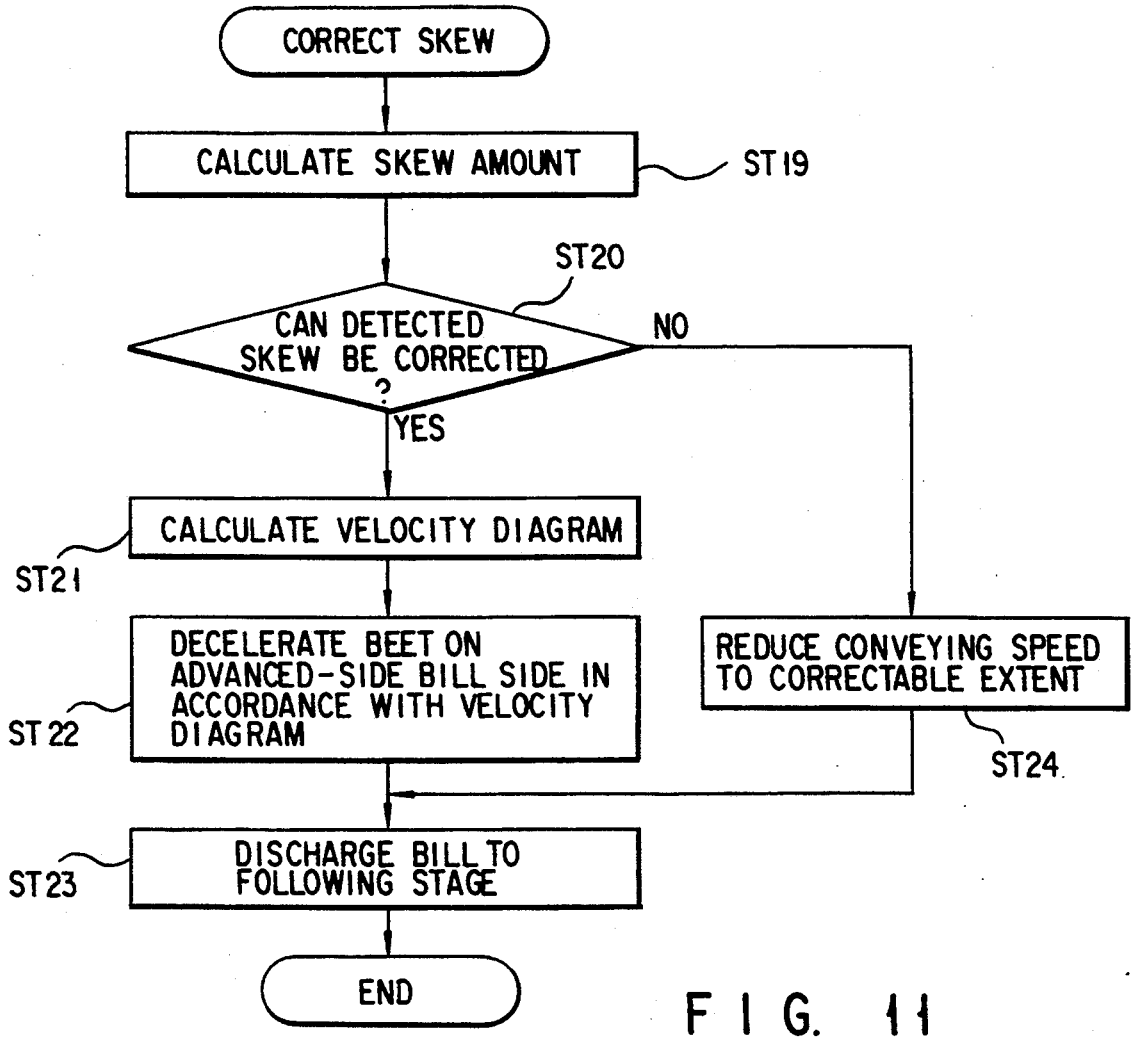
FIG. 11 is a flow chart for explaining the skew correct for the first embodiment of the present invention.

As seen from FIG. 10E, the controller 41 computes an amount of control, ΔX, so that, within a P(n)-to-P(n−1) conveying interval X2(n−1) of 50 mm or less than 50 mm, the conveying interval X1(n) exceeds 60 mm. The controller 41 accelerates the pulse motors 53, 54 on the basis of a result of computation. This results in narrowing the P(n−1)-to-P(n) conveying interval X2(n−1) but broadening the P(n)-to-P(n+1) conveying interval.

The controller performs such processing and enables the bill P which has been passed through the conveying device 50 to be more advanced than when processing is performed at a normal conveying speed. By so doing, the controller is so controlled that, even when the conveying interval exceeds 60 mm, upon acceleration by the conveying device 50, in the case where a bill P whose initial conveying interval is short is detected by the sensors 51, 52, a conveying interval relative to the preceding bill P presents no problem.

The conveying device so constructed is arranged immediately after the feeder mechanism 6 and, by so doing, any abnormal conveying interval of the bill P occurring at the feeder mechanism 6 in the supplying section 3 can be corrected by the conveying device 50. In this way, the abnormal conveying interval can be corrected by the conveying device 50 and then the bill P is supplied to the inspecting section 8, etc., at a subsequent stage so that there is less inconvenience upon the separating/supplying of the bill P at the feeder mechanism 6.

Further, the conveying device (sheet conveying device) of the embodiment can achieve its purpose if it is equipped with a speed-controllable conveying path independent of a normal conveying path as well as a detecting means for detecting the conveying interval. Rollers may be used instead of the conveying belts and a speed-controllable motor, such as a servo motor, may be used instead of the pulse motor.

The skew correction operation of the conveying device 50 will be explained below with reference to FIGS. 11 to 15.

Figure 12:
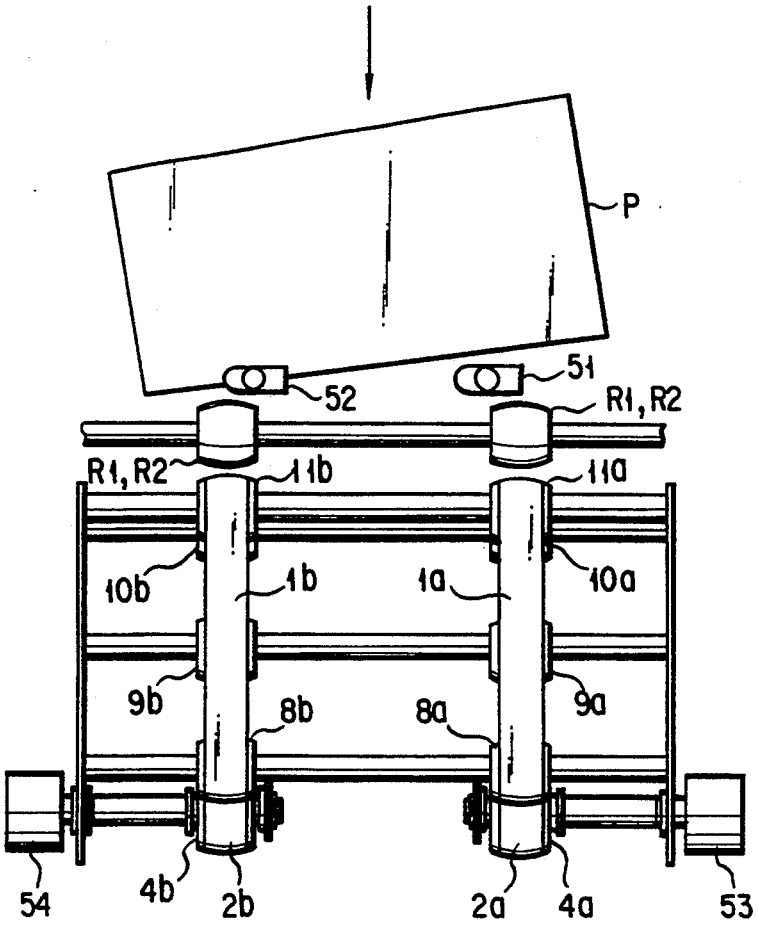
FIG. 12 is a view for explaining the skew detection of a bill.

Let it be assumed that the bill P(n) fed by the feeder mechanism 6 at the speed of 1600 mm/s from the supplying section 5 is fed, while interrupting the light from the sensors 51 and 52, past the feed rollers R1 and R2 at the same speed at which time the bill P is skewed at such an angle as shown in FIG. 12. In this connection it is to be noted that the bill processing apparatus is fed at a normal speed of 1600 mm/s.

The bill P(n) is fed by the feeder mechanism 6 and, upon reaching the position shown in FIG. 12, it interrupts light coming from the sensor 52.

Figure 13:
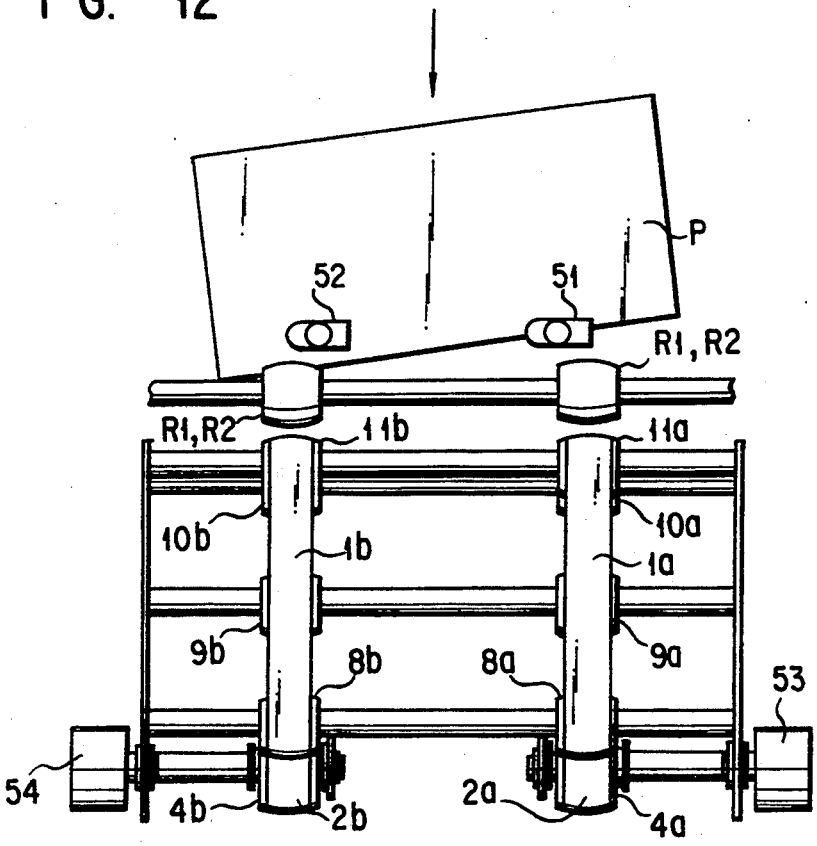
FIG. 13 is a view for explaining the skew detection of the bill.
Figure 14A:
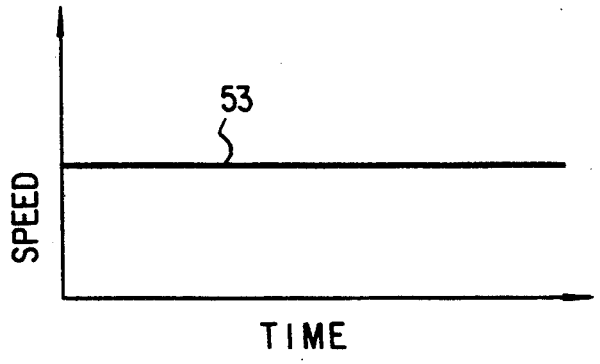
FIG. 14A is a view for explaining a speed diagram of a motor.
Figure 14B:
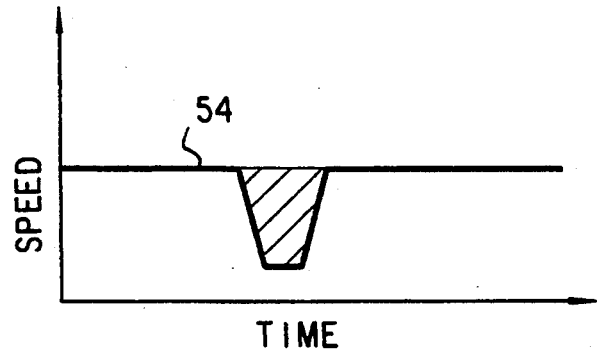
FIG. 14B is a view for explaining a speed diagram of another motor.

The controller 55 measures, based on the respective output signals of the sensors 51 and 52, a time for the bill to reach a state shown in FIG. 12 from a state shown in FIG. 13 and computes the amount of skew and direction of the bill P(n) from the distance between the optical axes of the sensors 51 and 52. Here the direction of the skew is so defined that it is a positive skew when it is a CCW (counterclockwise) direction and a negative skew when it is a CW (clockwise) direction. FIGS. 12 and 13 show the positive skew.

The controller 55 determines whether or not the skewed bill can be corrected from a calculated amount of skew. When the amount of skew is too great to be corrected, the controller 55 feeds the bill P(n) to the following stage while the conveying speed of the conveying device 50 is kept at the normal speed.

When the controller 55 determines that the amount of skew can be corrected, the bill P leaves the feed rollers R1 and R2 and is conveyed by the belts 1*a*, 1*b*, 2*a* and 2*b* of the conveying device 50, in a gripping relation, at the same speed as that of the conveying rollers R1 and R2, and is fed, by the belts 1*a*, 1*b*, 2*a* and 2*b* alone, in that gripping relation. At that time, the pulse motors 53 and 54 for driving the respective belts 1*a*, 1*b*, 2*a* and 2*b* are driven at the same rotation speed.

At this stage, the controller 55 performs processing such that, as a result of measurement based on the output signal of the sensor, it makes constant (1600 mm/s) the speed of the belts 1*a*, 2*a* conveying the left side, that is, delayed side of the bill P in a gripping relation as viewed in the conveying direction and decelerates the belts 1*b*, 2*b* conveying the right side, that is, the advanced side of the bill P as viewed in the conveying direction of the bill P. At that time, the pulse motor 53 for driving the belts 1*b* and 2*b* is decelerated.

As a result, the bill P is rotated by an extent to which the right side belts 1*b*, 2*b* are delayed in comparison with that speed of the left side belts 1*a*, 2*a*. By so doing it is possible to correct the amount of skew of the bill P. The corrected amount of skew can be found from a cross-hatched area for a pulse motor FIG. 14B) 54 plotted relative to the pulse motor 53 shown in FIG. 14A.

That is, for the drive roller 4*a* on the left side as viewed in a direction of conveyance at a uniform motion for a given period of time, the controller determines to how slow the right-side drive roller 4*b* is moved in that direction of conveyance. For example, let it be assumed that the skew angle is set to be 10° and that the distance between the optical axis of the sensor 51 and that of the sensor 52 is 80 mm. In this case it is necessary to make a CW-direction correction and hence to move the right-side drive roller 4*b* for a unit period of time by a less extent of 80−tan(10°)=14.1 mm .

The controller 55 computes these calculations and accelerates the pulse motor 54 for driving the "advanced side" belts 1*b*, 2*b* involved in the above case. For example, the controller 55 controls the speed of the right-side drive roller 4*b* such as to move the right-side belts (1*a*, 2*b*) by a distance 36 mm while moving the left-side belts (1*a*, 2*a*) by a distance 50 mm and corrects the skew of the bill P so that the bill is conveyed in a skewless fashion.

After the completion of such control, the right- and left-side belts (1*a*, 1*b*, 2*a*, 2*b*) are thus returned back to the normal speed and fed at the normal speed so that the bill P is transferred to the conveying rollers R3 and R4 driven at the speed of 1600 mm at the following stage.

The pulse motors 53 and 54 need to be accelerated or decelerated at rapid speeds because aforementioned processing is performed on the order of 40 ms.

In the case where the skew of the bill P is to be corrected as shown in FIG. 13, the skew of the bill P can be also corrected by driving the right-side (advanced-side) belts 1*b*, 2*b* at the normal speed in the conveying direction while driving the left-side (delayed-side) belts 1*a*, 1*b* at an accelerated speed in the conveying direction.

Figure 15:
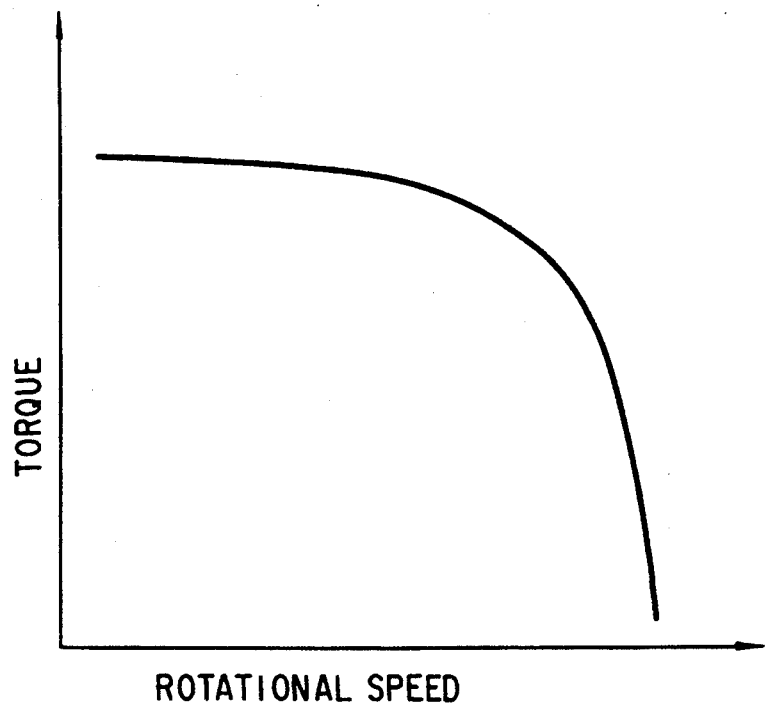
FIG. 15 is a characteristic curve for a pulse motor torque.

As shown in FIG. 15, however, there is a tendency that the rotational speed-to-torque characteristic curve of an ordinary pulse motor will be lowered with an increasing rotational speed of the pulse motor. The skew correction using the increasing rotational speed of the pulse motor is not proper because no necessary torque is obtained from the torque characteristic of the pulse motor. It is, therefore, necessary to use a very large pulse motor so that necessary torque may be secured.

The skew correction can be achieved by decelerating the "advanced-side" pulse motor, thus reducing the size of the pulse motor and hence the conveying device 50.

In actual practice, the interval at which, for example, the bill P of 76 mm in length is conveyed on the bill processing apparatus is usually of the order of 76 mm. Since the skew control is performed on the conveying device for a conveying interval of about 50 mm, proper processing can be done at a proper timing.

The aforementioned control is continuously performed on all the bills passing through the conveying device 50 so that the skew of the bill can be restricted to a given value.

In the case where the skew of the bill in the CW or CCW direction is too great to be corrected, it is possible to select a maximal possible correction against the bill or to convey the bill at the normal conveying speed without performing that skew correction.

As set out above, by locating the conveying device 50 directly after the feeder mechanism 6 as shown in FIG. 1, the skew of the bill P occurring at the feeder mechanism 6 in the supplying section 5 can be corrected by the immediately following conveying device 50. By correcting the skew of the bill at the conveying device 50 and supplying it to the inspecting section 8, etc., at the following stage it is possible to reduce any inconvenience occurring when the bills are supplied to the following stage while being separated one from another.

The simultaneous correction of the skew and short pitch will be explained below based on the flow chart of FIGS. 16 and 17.

If both the skew and short pitch are simultaneously to be corrected, it is necessary to perform the skew correction while increasing the speeds of the motors 53 and 54. That is, it is necessary to perform skew correction somewhat different from the aforementioned skew correction.

Figure 16:
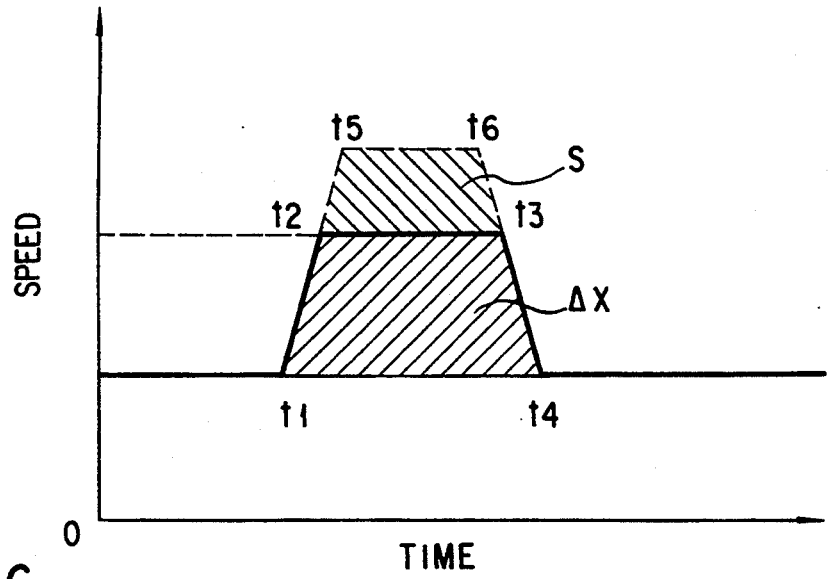
FIG. 16 is an explanative view showing a pulse motor speed variation in the first embodiment.
Figure 17:
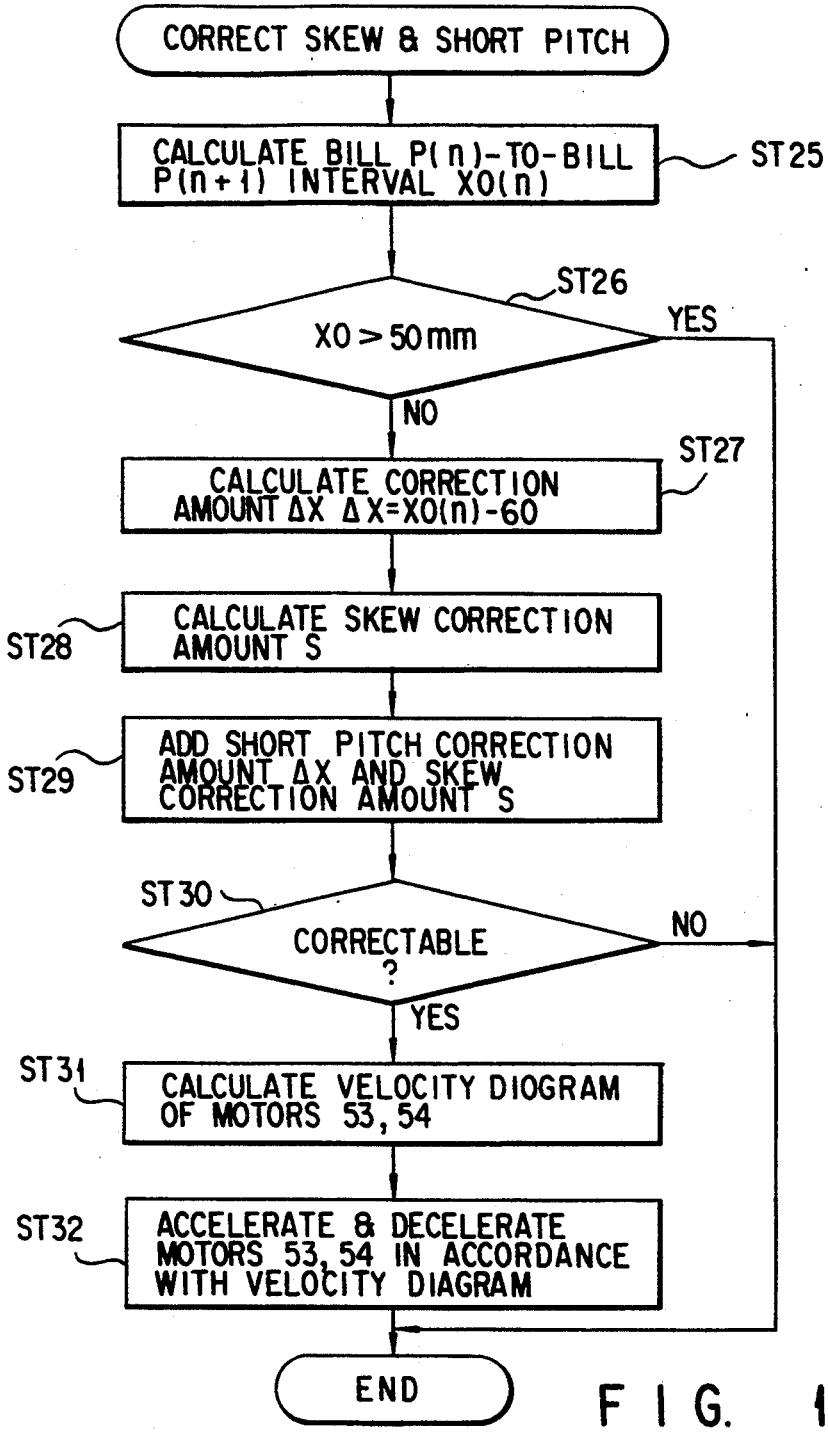
FIG. 17 is a flow chart for the skew and the short pitch correct for the first embodiment of the present invention.

That is, it is necessary, as shown in FIG. 16, to calculate the velocity diagram from an amount of correction, $\Delta X$, of the short pitch and amount of correction, S, of the skew for every motors 53 and 54.

For this reason, the amount of correction, $\Delta X$, of the short pitch and amount of correction, S, being calculated (ST's 27 and 28), are added to provide a maximum amount of correction (ST29). It is then determined whether or not the maximum amount of correction is below a maximally correctable upper limit as shown in FIG. 9—ST30.

If it is correctable, the velocity diagram of the motors 53 and 54, that is, the diagram shown by the solid and dash lines in FIG. 16, is calculated (ST31) and the motors 53 and 54 are accelerated and decelerated in accordance with the velocity diagram.

Figure 18:
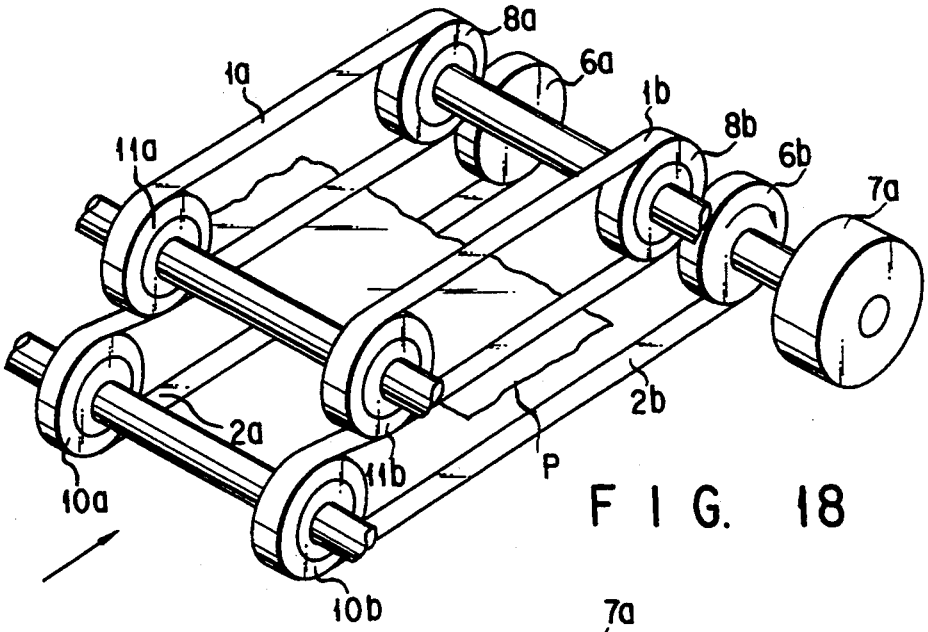
FIG. 18 is a perspective view diagrammatically showing a sheet conveying device according to a second embodiment of the present invention.
Figure 19:
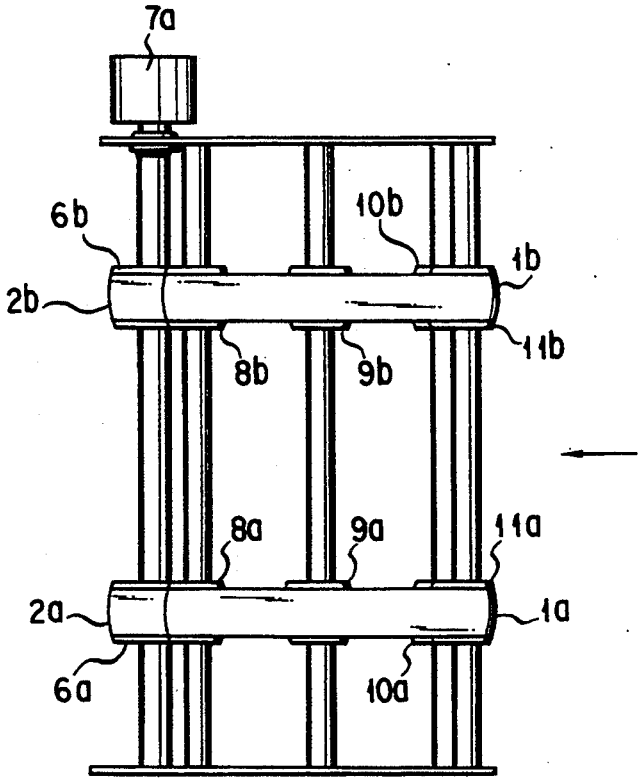
FIG. 19 is a plan view showing an arrangement of the conveying device of the second embodiment.
Figure 20:
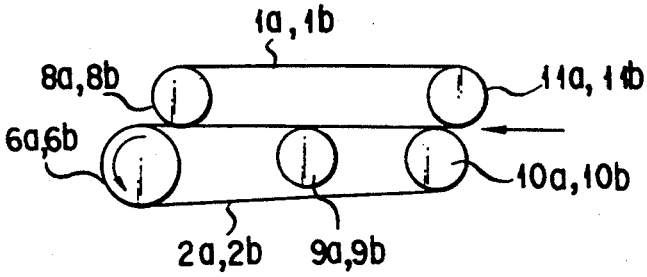
FIG. 20 is a side view showing an arrangement of the conveying device of the second embodiment.

FIGS. 18, 19 and 20 show, in more detail, the conveying device according to the another embodiment of the present invention.

As will be seen from these Figures, endless driven belts 1*a* and 1*b* are arranged in parallel array and spaced a predetermined distance from each other with the belt 1*a* run around rotatable rollers 8*a* and 11*a* and the belt 1*b* run around the rotatable rollers 8*b* and 11*b*. These driven belts serve as a band-like conveying means. Further, endless drive belts 2*a* and 2*b* are also arranged, in parallel array, in contact with the associated driven belts 1*a* and 1*b*, respectively, with the belt 2*a* entrained around rotatable roller 10*a* and drive roller 6*a* and the belt 2*b* entrained around rotatable roller 10*b* and driver roller 6*b*. These belts 2*a* and 2*b* serve as band-like conveying means. These arrangements enable the bill P to be conveyed in a direction of an arrow in FIG. 18 in a manner to have its opposed edges gripped between the belts 2*a* and 1*a* on one hand and the belts 2*b* and 1*b* on the other hand. It is to be noted that rotatable rollers 9*a* and 9*b* supports the intermediate portions of the belts 2*a*, 1*a* and 2*b*, 1*b*.

The drive rollers 6*a* and 6*b* can be driven at any given speed in any given direction by a pulse motor 7*a* and controller (to be described later) and can be varied in their speed timewise.

The drive belts 2*a* and 2*b* are moved by the pull of the drive rollers 6*a* and 6*b* and hence the driven belts 1*a* and 1*b* are frictionally moved by the associated opposed drive belts 2*a* and 2*b*, respectively.

Figure 21:
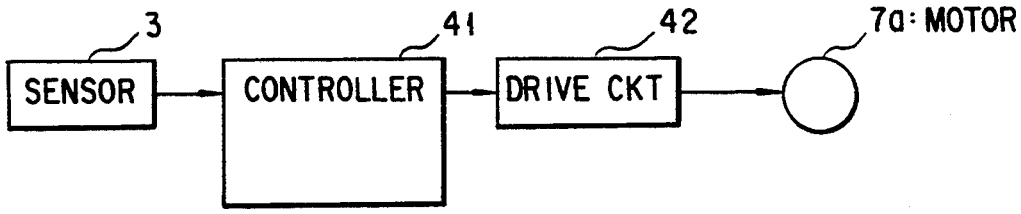
FIG. 21 is a view diagrammatically showing an electric circuit for the conveying device of the second embodiment.

FIG. 21 diagrammatically shows an electric circuit for the conveying device so configured as set out above. That is, an output signal of a sensor 3 is sent to the controller 41 as set out above. The controller 41 measures, based on the output signal of the sensor 3, the conveying interval of the bill P, . . . , at a timing corresponding to light interruption at the sensor 3 by the passage of the bill P there and controllably drives the pulse motor 7*a*, through a drive circuit 42, on the basis of a result of measurement.

In the conveying device of the present invention it is not possible to perform right/left control. It is possible to correct the short pitch only and, in spite of it, to achieve cost reduction compared with that involved on the conveying device 50.

Although the aforementioned embodiment has been explained as being applied to the bill processing apparatus, such as a bill arranging machine, the present invention is not restricted thereto. For example, the present invention may be applied to a bill processing unit for an automatic processing apparatus, such as an automatic teller machine in the financial institution such as banks.

Although the aforementioned embodiment has been explained as being applied to the bill processing apparatus, the present invention is not restricted thereto. The present invention can also be applied to the sheet conveying device for an apparatus for processing not only the bill but also, for example, an negotiable instrument, mail, forms, etc.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A device for conveying sheets comprising:

first feeding means for continuously feeding the sheets one by one;

second feeding means for feeding the sheet fed by the first feeding means at a predetermined velocity;

detecting means arranged between the first and second feeding means, for detecting the sheet continuously fed by the first feeding means;

means for judging any improper interval between the sheet and the subsequent sheet on the basis of detection results of the detecting means;

means for, when the improper interval is judged by the judging means, varying the velocity of the second feeding means so as to correct the interval.

2. The conveying device according to claim 1, wherein the detecting means includes means for detecting an interval between the sheet and a subsequent sheet on the basis of detection results.

3. The conveying device according to claim 1, wherein the judging means includes means for judging the sheet-to-sheet interval as being smaller than a minimum interval.

4. The conveying device according to claim 3, wherein the varying means includes;

interval difference calculating means for, when the sheet-to-sheet interval is judged by the judging means as being smaller than the minimum interval, calculating the difference between the sheet-to-sheet interval detected by the detecting means and a proper sheet-to-sheet interval; and means for accelerating the velocity of the second feeding means to advance the sheet relative to the subsequent sheet by an amount of value calculated by the interval difference calculating means.

5. The conveying device according to claim 1 wherein said detecting means include a plurality of detection sensors, provided in a direction perpendicular to the feeding direction of the sheet, for detecting passage of the sheet;

said second feeding means comprises:

first conveying means for conveying the sheet with its one end side gripped therewith in the direction perpendicular to the conveying direction of the sheet passed over the detecting sensors;

second conveying means for conveying the sheet with its other end side gripped in the direction perpendicular to the conveying direction of the sheet passed over the detection sensors;

first drive means for driving the first conveying means at a predetermined velocity;

second drive means for driving the second conveying means at a predetermined velocity;

said varying means includes:

means for calculating the improper interval between the sheet and subsequent sheet on the basis of output signals of the detection sensors;

first detecting means for detecting any improper interval on the basis of results of the calculating means;

second detecting means for detecting an amount of skew of the sheet from the difference of passing timing at which the sheet is detected by the detection sensors;

first means for, when the improper interval is detected by the first detecting means, varying the velocity of the first and the second conveying means on the basis of results of the calculating means so as to correct the interval; and second means for varying the velocity of the first or the second conveying means on the basis of an output signal of the second detecting means so as to correct a skewed state of the sheet.

6. The device according to claim 1, wherein the second feeding means includes:

first conveying means for conveying the sheet with one end side gripped therewith in a direction crossing a direction in which the sheet is fed from the first feeding means;

second conveying means for conveying the sheet with the other end side gripped therewith in a direction crossing the conveying direction of the sheet fed from the first feeding means;

first drive means for driving the first conveying means at a predetermined velocity; and second drive means for driving the second conveying means at a predetermined velocity.

7. The device according to claim 1, wherein the detecting means includes a plurality of detection sensors provided in the direction crossing the feeding direction of the sheet so as to detect passage of the sheet.

8. The device according to claim 1, wherein the second feeding means includes first conveying means for conveying the sheet with one end side gripped therewith in a direction crossing a direction in which the sheet is fed from the first feeding means, second conveying means for conveying the sheet with the other end side gripped therewith in a direction crossing the conveying direction of the sheet fed from the first feeding means, first drive means for driving the first conveying means at a predetermined velocity, and second drive means for driving the second conveying means at a predetermined velocity, said detecting means includes a plurality of detection sensors provided in the direction crossing the feeding direction of the sheet so as to detect passage of the sheet, said varying means includes calculating means for calculating an interval of the sheet and subsequent sheet on the basis of output signals of the detection sensors, first detecting means for detecting an improper interval of the sheet and subsequent sheet on the basis of the result of the calculating means, second detecting means for detecting an amount of skew of the sheet from a timing difference detected by the detection sensors, first varying means for, when the improper interval is detected by the first detecting means, varying the velocities of first and second conveying means on the result of calculation by the calculating means to correct that improper interval, and second varying means for varying one of the velocities of the first and second conveying means on the basis of the output signal of the second detecting means so as to correct any skewed state of the sheet.

* * * * *